US005323736A

United States Patent [19]

Pascal

[11] Patent Number: 5,323,736

[45] Date of Patent: Jun. 28, 1994

[54] STEAM GENERATOR WITH DEVICE FOR THE DISTRIBUTION OF FEED WATER AND RECIRCULATION WATER IN THE SECONDARY PART

[75] Inventor: Yves Pascal, Nanterre, France

[73] Assignee: Framatome, Paris la Defense, France

[21] Appl. No.: 53,388

[22] Filed: Apr. 28, 1993

[30] Foreign Application Priority Data

Apr. 28, 1992 [FR] France ..... 92 05219

[51] Int. Cl.[5] ..... F22B 1/02

[52] U.S. Cl. ..... 122/32; 122/382

[58] Field of Search ..... 122/32, 34, 381, 382

[56] References Cited

U.S. PATENT DOCUMENTS 3,916,844 11/1975 Cassell ..... 122/32
4,208,987 6/1980 Chaix et al. ..... 122/32
4,357,908 11/1982 Yazidjian ..... 122/32
5,110,538 5/1992 Pascal et al. ..... 122/32 X

FOREIGN PATENT DOCUMENTS 0183049 6/1986 European Pat. Off. .
2244129 9/1973 France .
1126306 9/1968 United Kingdom .

*Primary Examiner*—Edward G. Favors
*Attorney, Agent, or Firm*—Pollock, Vande Sande & Priddy

[57] ABSTRACT

In a steam generator or boiler used in a nuclear reactor, the secondary water is supplied via at least one pipe (48) issuing directly into the bottom of an annular recirculation space (32) formed between the outer envelope (10) and an inner envelope (26) surrounding inverted U-tubes (24), on the side of the cold branches of the tubes. A perforated collar or flange (56) placed in the annular space (32), above the pipe (48), produces a pressure drop or flow limitation preventing the rise of the feed water and controls the circumferential distribution of the recirculation water, which drops from the separators (28).

9 Claims, 4 Drawing Sheets

STEAM GENERATOR WITH DEVICE FOR THE DISTRIBUTION OF FEED WATER AND RECIRCULATION WATER IN THE SECONDARY PART

FIELD OF THE INVENTION

The invention relates to a steam generator or boiler for use in a pressurized water nuclear reactor and which has means for ensuring a controlled distribution of the feed water injected into the bottom of the boiler and recirculation water resulting from the condensation of the secondary stream, in the upper part of the boiler.

BACKGROUND OF THE INVENTION

As more particularly illustrated by FR-A-2 477 265, a boiler equipping a nuclear power station normally comprises a vertically positioned outer envelope, whose inner space is subdivided into two parts in the height direction by a horizontal plate known as a tube plate. The ends of the tubes of a bundle of inverted U-tubes are fixed to the tube plate and issue below the latter respectively into an admission collector or header and into a discharge collector or header for the water circulating in the primary circuit of the reactor and known as primary water. The water circulating in the secondary circuit of the reactor and known as secondary or feed water is injected into that part of the boiler positioned above the tube plate.

In the boiler described in FR-A-2 477 265, the feed water is injected by a semitoroidal, main supply collector, positioned above an annular recirculation space formed between the outer and inner envelopes covering the bundle of tubes and having its lower edge spaced from the tube plate.

The feed water introduced into the boiler by the main supply collector drops into the annular space and then rises between the tubes of the bundle within the inner envelope. The heat taken from the primary water circulating within the tubes then has the effect of evaporating the feed water when it enters the upper region of the lower envelope. The steam thus formed then traverses separators and driers, which lower the moisture content of the steam before the latter escapes to the turbines of the secondary circuit used for driving the electricity generators of the power station.

The condensation water held in the separators, generally referred to as recirculation water, descends again by gravity into the annular recirculation space, in order to again pass through the inner envelope of the generator.

The positioning of the main supply collector of the boiler above the annular recirculation space leads, as shown in FR-A-2 477 265, to the equipping of the collector with inverted J-shaped tubes, in order to prevent pressure jumps and surges, which might occur during the restarting of the pumps of the secondary circuit as a result of a pumping out of the supply collector. However, this procedure suffers form the disadvantage of complicating the manufacture of the boiler and consequently extending the manufacturing process and making it more expensive.

Moreover and as illustrated by U.S. Pat. Nos. 3,804,069, 3,896,770 and 3,916,843, consideration has also been given to supplying the feed water to a boiler by directly connecting a feed water admission pipe to a lower part of the inner envelope, so as to make the water penetrate directly at the bottom of the cold branches of the tubes of the bundle. Deflectors positioned facing the admission pipe and around the cold branches then form a device for preheating the feed water circulating between the tubes.

Even though the solution described in the latter documents avoids the disadvantages caused by the installation of the main supply collector in the upper part, it suffers from the disadvantage of the subjecting the lower parts of the cold branches of the tubes to significant transverse flows and of not permitting controlled distribution of the feed water flow rate over the boiler cross-section.

Moreover, if migrating bodies such as welding rods, screws, bolts, etc., inadvertently introduced into the secondary circuit during their manufacture, enter the steam generator by the admission pipe for the feed water, they can jam between the tubes of the bundle and damage the tubes.

Moreover, the existing boilers in which the introduction of the feed water takes place in the bottom of the secondary part do not make it possible to carry out a controlled distribution of the feed water and the recirculation water on the periphery of the boiler, whereas such a controlled distribution would be desirable in order to bring about an optimum reconciliation between the contradictory requirements, among which reference is mainly made to:

- obtaining maximum efficiency of the steam generator in normal operation;
- the need to ensure a satisfactory operation of the steam generator during an incident requiring the use of a standby or emergency supply collector, generally positioned above the annular recirculation space; and
- reducing to a minimum the thermal stresses suffered by the outer envelope and the tube sheet of the boiler.

SUMMARY OF THE INVENTION

The invention specifically relates to a boiler, whose original design has the main supply collector located in the bottom of the secondary part, while ensuring controlled distribution of the feed water and recirculation water on the periphery of the secondary part of the boiler and while allowing trapping of any migrating bodies which may have come from the feed water circuit and which might penetrate the tube bundle and damage the tubes.

According to the invention, this result is obtained by means of a boiler comprising:

- a vertically axed, outer envelope,
- a horizontal tube plate tightly fixed within the outer envelope,
- a bundle of inverted U-tubes having hot branches and cold branches and each having two ends fixed to the tube plate and issuing below the latter, respectively into an admission collector and into a discharge collector for the primary fluid,
- an inner envelope covering the tube bundle and having a lower edge spaced from the tube plate and forming with the outer envelope an annular recirculation space,
- secondary water supply means, and
- means for the separation of recirculation water able to drop again through the recirculation space and secondary steam which can be extracted from the boiler, the separating means being positioned above the inner envelope. The secondary water supply means comprises at least one supply pipe issuing directly into the annular recirculation space, at least one perforated collar being placed in the annular recirculation space at a higher level than that of the supply pipe, so as to oppose any raising of the secondary water into this space and so as to ensure controlled circumferential distribution of the recirculation water descending into the space.

The perforated collar placed in the annular recirculation space above the supply pipe brings about a flow limitation or a sufficiently high pressure drop to impose on the feed water entering the annular space a downward movement and for controlling the proportion of recirculation water penetrating into the space, particularly in the region above the supply pipe.

Preferably, to ensure that migrating bodies from the secondary water and entering the boiler by the supply pipe do not reach the tube of the bundle, first means for trapping the migrating bodies are placed in the annular recirculation space at a level below that of the supply pipe.

When a standby supply collector is placed above the annular recirculation space, second migrating body trapping means are placed in the annular recirculation space below the standby supply collector.

In order to contribute to the downward orientation of the feed water entering the boiler by the supply pipe, a deflector is advantageously placed within the annular recirculation space, in the extension of the supply pipe.

The invention can be applied to steam generators or boilers having an economizer or an evaporator.

In the case of economizer boilers having an intermediate skirt at least partly duplicating the inner envelope around cold branches of the tubes, so as to define with the inner envelope a superheated zone belonging to the annular recirculation space, the supply pipe issues directly into the superheated zone and the perforated collar is also placed therein.

In the case of an economizer boiler without an intermediate skirt and in which the annular recirculation space is subdivided into a first region surrounding the cold branches of the tubes and a second region surrounding the hot branches of the tubes by vertical partitions, the supply pipe issues into the first region and the perforated collar is placed thereabove.

Finally, in the case of an evaporator-type boiler having no separation between the hot and cold branches of the tubes, the supply pipe issues into the annular recirculation space on the side of the cold branches of the tubes, the perforated collar extending over the entire circumference of the annular space. A distribution collar having perforations with a variable section then extends over the entire circumference of the annular space at a level below that of the supply pipe.

Optionally, the perforated collar can also fulfill the function of trapping migrating bodies introduced into the boiler through the standby supply collector. The collar then has perforations with a maximum diameter smaller than the minimum distance between the tubes of the bundles.

In a comparable way, the distribution collar used in the case of an evaporator-type boiler can also optionally fulfill the function of trapping the migrating bodies. The perforations of the distribution collar then have a maximum diameter smaller than the minimum distance between the tubes of the bundle.

BRIEF DESCRIPTION OF THE DRAWINGS

The invention is described in greater detail hereinafter relative to several embodiments and with reference to the attached drawings.

DESCRIPTION OF THE PREFERRED EMBODIMENTS

Figure 1:
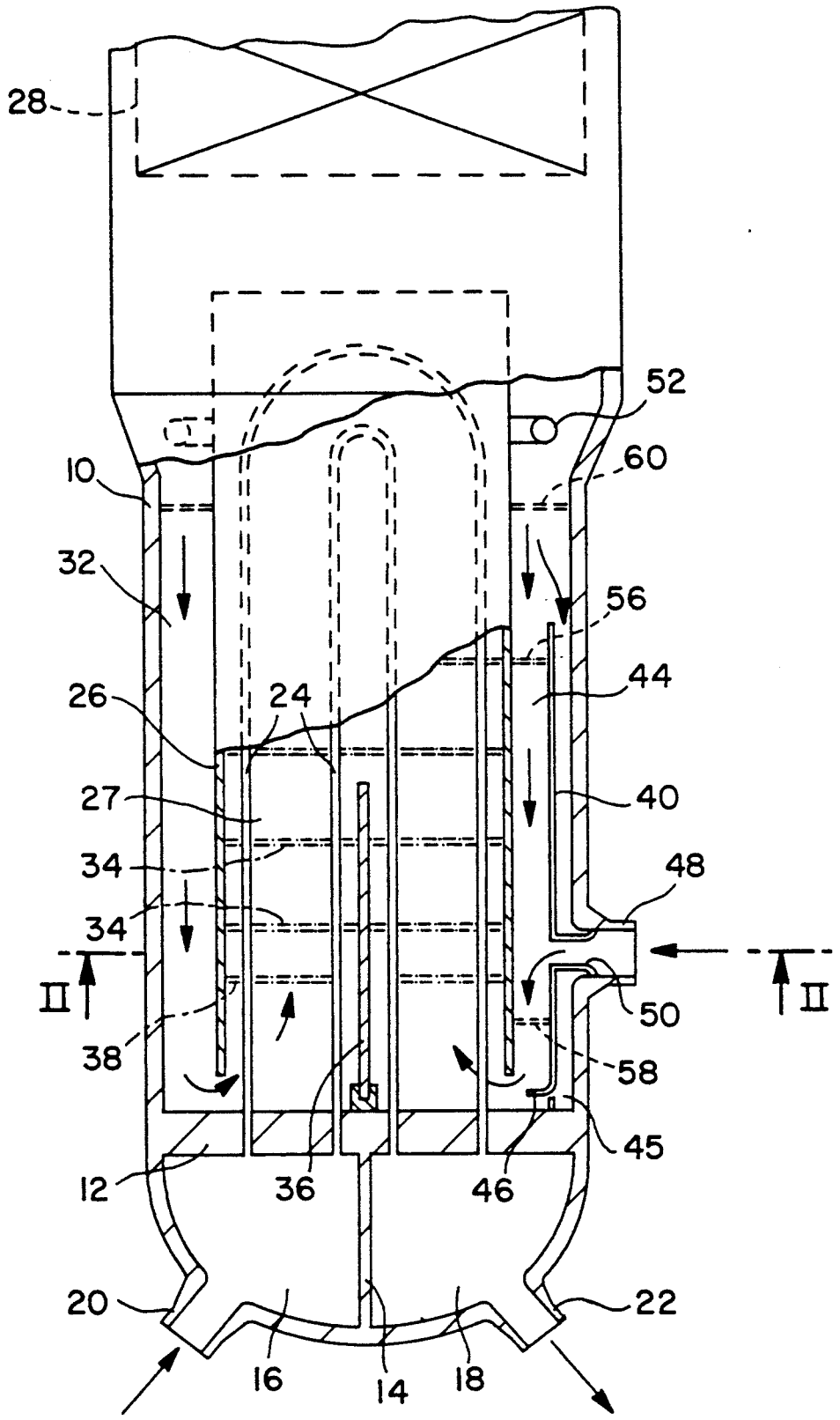
FIG. 1 is a vertical sectional view schematically illustrating an economizer-type boiler with an intermediate skirt produced according to the invention.

FIG. 1 shows the vertically axed, outer envelope of revolution 10 of a steam generator or boiler for ensuring heat transfer between the primary water circuit and the secondary water-steam circuit of a pressurized water nuclear reactor. More specifically, the boiler schematically illustrated in FIG. 1 is an economizer-type boiler with an intermediate skirt.

The outer envelope 10 defines a closed inner space subdivided into a primary lower zone and a secondary upper zone by a horizontal tube plate 12 tightly connected to the outer envelope 10.

A vertical partition 14 subdivides the primary lower zone, normally known as the water box, into an admission collector or header 16 and a discharge collector or header 18 for the water circulating in the reactor primary circuit. Pipes 20 and 22 form part of the water box and respectively connect the collectors 16 and 18 to the primary circuit.

A bundle of inverted U-tubes 24 is tightly connected to the tube plate 12, in the upper secondary zone defined by the latter. More specifically, each of the tubes has a hot vertical branch, whose lower end issues into the admission collector 16 and a cold vertical branch, whose lower end issues into the discharge collector 18.

The tube bundle 24 is surrounded and covered by an inner envelope 26 arranged coaxially in the outer envelope 10. The upper part of the inner envelope 26 communicates with water-steam separators 28, which issue at their upper ends into driers (not shown) connected to a not shown steam discharge pipe (not shown), located at the top of the outer envelope 10. The lower edge of the inner envelope 26 is placed at a given distance above the tube sheet 12, so as to form a passage between an annular recirculation space 32 defined between the envelopes 10 and 26 and the space 27 within the inner envelope 26. Horizontal spacing plates 34, which are regularly spaced over the entire height of the tube bundle 24, secure the tubes within the inner envelope 26.

Figure 2:
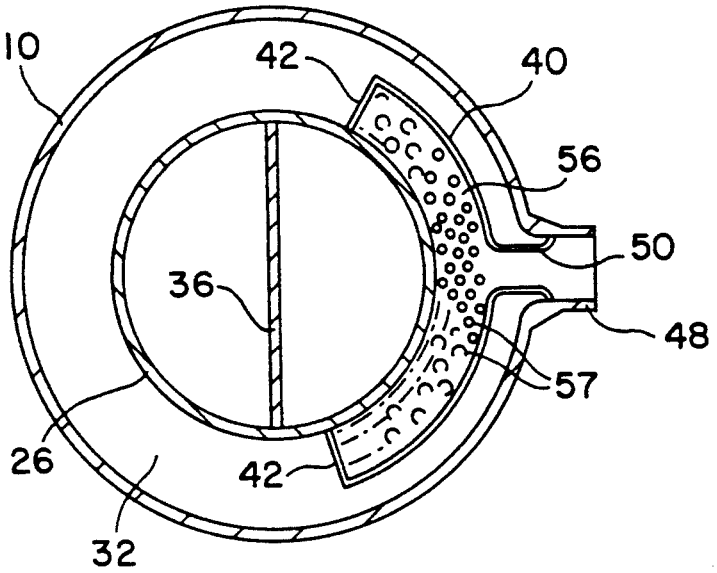
FIG. 2 is a sectional view along line II—II of FIG. 1.

In the boiler with economizer and intermediate skirt illustrated in FIGS. 1 and 2, a vertical partition 36 rises into the tube bundle from the tube sheet 12, between the hot and cold branches of the tubes 24, so as to physically separate these two branches over the entire lower part of the space 27 defined in the inner envelope 26.

On either side of vertical partition 36 and below spacing plates 34 is located a distribution plate 38 having a different permeability on the side of the hot and cold branches, respectively, so as to ensure effective scavenging of the tube sheet 12 and maximum homogeneous distribution of the feed water, mixed with the recirculation water, which rises within the inner envelope 26.

The boiler of FIGS. 1 and 2 also comprises an intermediate skirt 40, which at least partly encircles the inner envelope 26 on the side of the cold branches of the tubes 24, as illustrated in FIG. 2. The two circumferential ends of skirt 40 are connected to the inner envelope 26 by two end partitions 42 (FIG. 2), so as to form within the annular recirculation space 32 a superheated zone 44, defined between the inner envelope 26, the skirt 40 and the partitions 42.

The intermediate skirt 40 is connected at its lower end to the tube plate 12 and preferably has openings 45 in the vicinity of the plate in the manner schematically illustrated in FIG. 1. The latter also shows that the skirt 40 can support immediately above openings 45 a horizontal deflector 46 enabling the feed water flow descending within the superheated zone 44 to be deflected towards the central part of the boiler, when it comes into the vicinity of the tube plate 12. The intermediate skirt 40 rises in the annular recirculation space 32 to a level sufficiently above the tube plate 12, as illustrated in FIG. 1. In the embodiment illustrated in FIGS. 1 and 2, the entrance of the feed water into the boiler takes place, on the side of the cold branches of the tube bundle 24, by at least one supply pipe 48 connected to the outer envelope 10 of the boiler and extended by a thermal sleeve 50 directly connected to the intermediate skirt 40. Thus, the supply pipe 48 issues directly into the superheated zone 44.

In the embodiment illustrated in FIG. 1, the steam generator also comprises a toroidal standby supply collector 52 placed around the inner envelope 26, in the upper part of the annular recirculation space 32. In the case of an incident in the secondary circuit, this standby collector 52 can be supplied by a supply pipe (not shown), which tightly traverses the outer envelope 10. It issues within the boiler by perforations formed on its upper generatrix.

According to the invention, a perforated collar 56 is placed in the superheated zone 44 within the vicinity of the upper edge of the intermediate skirt 40, i.e., at a level significantly above that of the supply pipe 48. In the embodiment shown, the perforated collar 56 is flat and horizontal, extending over the entire cross-section of the superheated zone 44. As a variant, the collar may have a random shape and orientation, such as a curvilinear shape and/or an inclined orientation. The perforated collar 56 has perforations 57 (FIG. 2), whose shape, number and distribution make it possible to control the distribution of the feed water and the recirculation water in the secondary part of the boiler.

Figure 3:
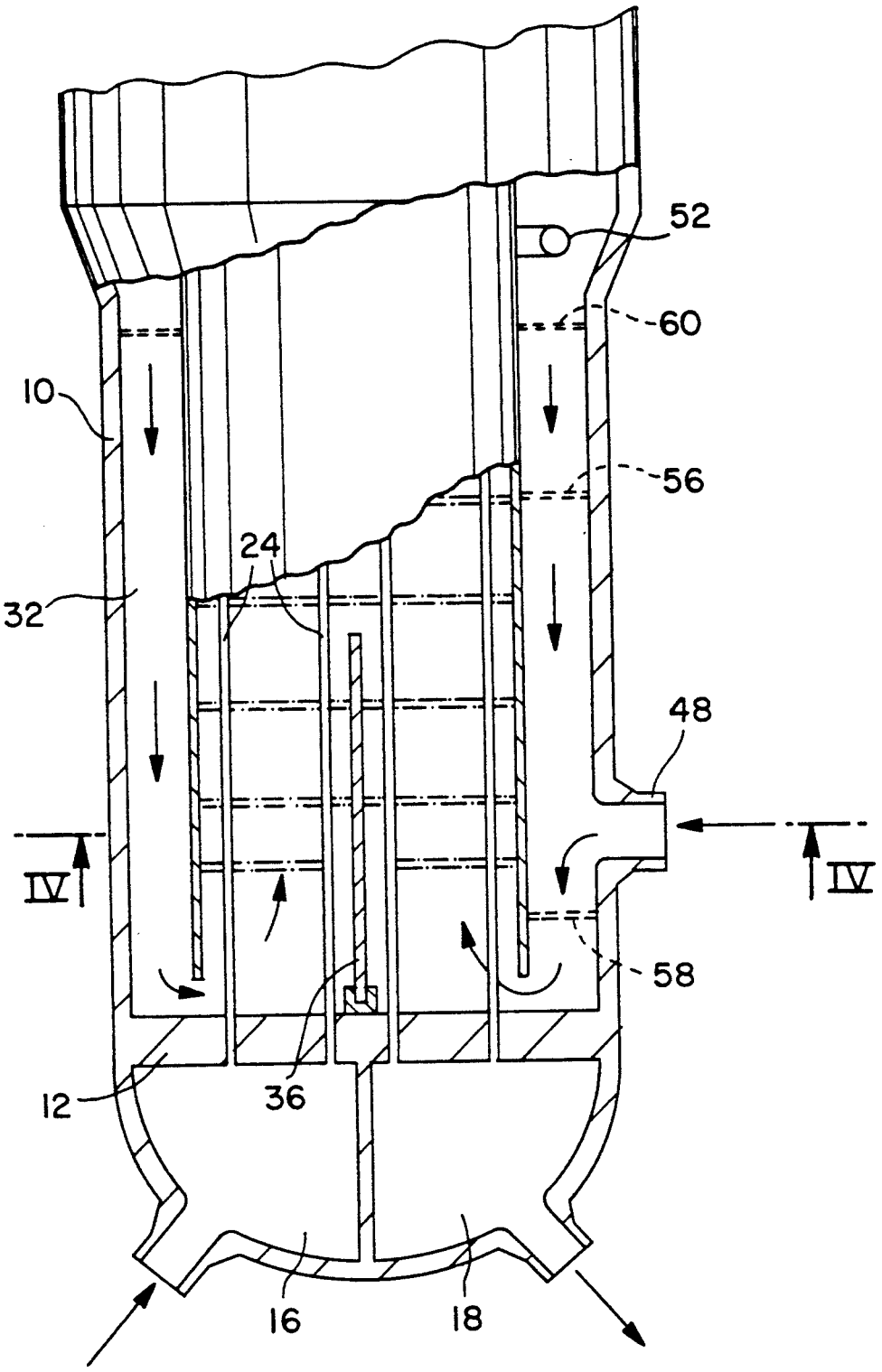
FIG. 3 is a vertical sectional view comparable to FIG. 1 illustrating an economizer-type boiler without an intermediate skirt and produced according to the invention.

Thus, in the case of an economizer-type boiler of the type illustrated in FIGS. 1 to 3, it is possible to give said perforated collar 56 characteristics making it possible to contain within the space 44 all the supply water form the side of the cold branches of the tube bundle 24, which makes it possible to ensure that the boiler operates at maximum efficiency. This result is obtained by giving to the flow limitation or pressure drop induced by the perforated collar 56 an adequate value to prevent the feed water introduced into the superheated zone 44 from rising beyond the upper edge of the intermediate skirt 40.

Moreover, the flow limitation or pressure drop also results in the redescent of the recirculated water into that part of the annular recirculation space 32 outside the superheated zone 44 rather than into said superheated zone. In combination with the openings 45 made in the bottom of the skirt 40, this assists the flow of the hotter recirculation water along the outer envelope 10 and the tube plate 12, which improves the thermal equilibrium of the outer envelope and the tube plate. Specifically and solely by way of example, the flow limitation or pressure drop induced by the perforated collar 56 can lead to allowing only approximately 10% of the recirculation water to pass into the superheated zone 44.

Finally, these same characteristics are not inconsistent with the requirement of ensuring downward circulation of the feed water on the side of the cold branches of the tubes 24, when an incident leads to the introduction of the feed water into the boiler by the standby supply collector 52.

In the embodiment shown in FIG. 1, the steam generator also has a first device 58 for trapping migrating bodies, placed in the superheated zone 44, at a level below that of the supply pipe 48. This essential function of device 58 is to prevent migrating bodies which might jam between the bundle tubes 24 from entering the tubes. Unlike the case of the perforated collar 56, this arrangement is designed to bring about a minimum flow limitation or pressure drop, so as not to reduce the efficiency of the apparatus. To this end, the device may be a grid, grating or equivalent system with a vary large number of passages, whose dimensions are smaller than the minimum distance separating the tubes 24.

In a comparable manner, a second migrating body trapping device 60, comparable to the device 58, is placed in the top of the annular recirculation space 52, below the standby supply collector 52, so as to prevent migrating bodies introduced into the boiler through the collector from jamming between the bundle tubes 24. The characteristics and structure of the device 60 are comparable to those of the device 58. To the right of these migrating body trapping devices 58 and 60, manholes can be provided in the pressure envelope 10 and in the skirt 40, so as to permit the removal of any trapped migrating objects.

In the steam generator or boiler described hereinbefore relative to FIGS. 1 to 3, the feed water entering the superheated zone 44 through the supply pipe 48 descends into the zone, particularly under the effect of the flow limitation or pressure drop induced by the perforated collar 56, as illustrated by the arrows in FIG. 1. The feed water then rises around the tubes 24 within the inner envelope 26 and mixes with the recirculation water descending in majority form into regions of the annular space 32 separate from the superheated zone 44, once again under the effect of the flow limitation or pressure drop induced by the perforated collar 56.

It should be noted that the permeability of the perforated collar 56 can vary circumferentially, so as to permit precise, local flow control.

Figure 4:
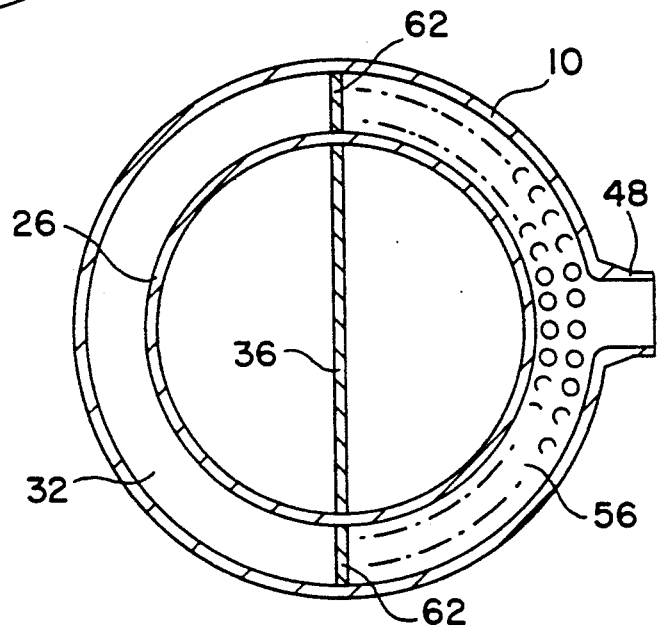
FIG. 4 is a sectional view along line IV—IV of FIG. 3.

FIGS. 3 and 4 show an economizer-type boiler which does not have an intermediate skirt. This boiler has numerous characteristics identical to that described hereinbefore, so that only the differing characteristics will be described.

Firstly, and as illustrated in FIG. 4, the vertical partition 36 separating the hot and cold branches of the tubes 24 of the bundle above the tube plate 12 is extended into the intermediate recirculation space 32 by two complementary, vertical partitions 62. Moreover, due to the disappearance of the intermediate skirt, the supply pipe or pipes 48 issue directly into the annular recirculation space 32 from the side of the cold branches of the tube 24.

In this case, the perforated collar 56 is placed directly in the annular recirculation space 32 at a level significantly above that of the supply pipe 48. The perforated pipe 56 extends over the entire width of the space 32 and over half the circumference of said space located on the side of the cold branches of the tubes 34, as shown in FIG. 3, up to the vertical partitions 62, which for this purpose rise to a height above that of the vertical partition 36 separating the hot and cold branches of the tubes.

As hereinbefore, the perforated collar 56 induces a flow limitation or pressure drop which is adequate to prevent the feed water introduced by the supply pipe 48 from rising above the upper edges of the partitions 62.

However, in this case the pressure drop or flow limitation can be slightly less than in the previous case, so that the scavenging of the outer enclosure 10 by the recirculation water is adequate on the side of the cold branches to prevent excessive thermal stresses being produced between that side of and the opposite side of the boiler.

As in the first embodiment, a migrating body trapping device 58 is placed at a level lower than that of the supply pipe 48, in that portion of the annular recirculation space 32 surrounding the cold branches of the tubes 24, between the partitions 62. A second migrating body trapping device 60 is also placed at the top of the annular recirculation space 32, over the entire periphery of that space, just below the standby supply collector. The characteristics and structures of the migrating body trapping devices 58 and 60 are identical to those described in connection with the first embodiment.

Figure 6:
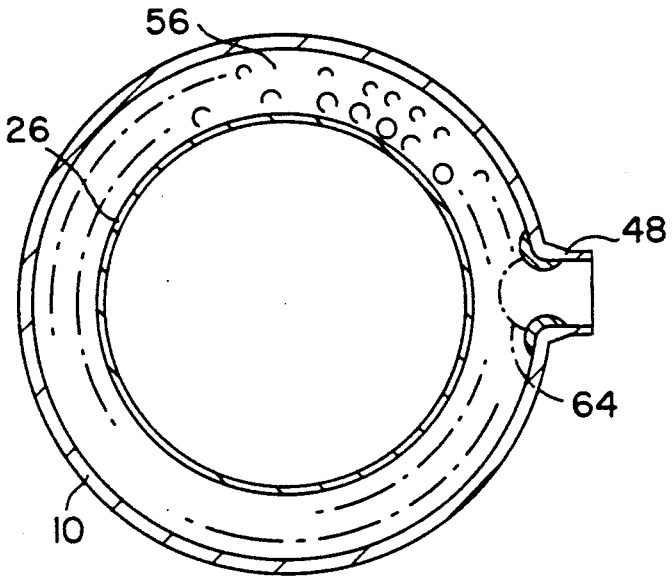
FIG. 6 is a section view along line VI—VI of FIG. 5.
Figure 5:
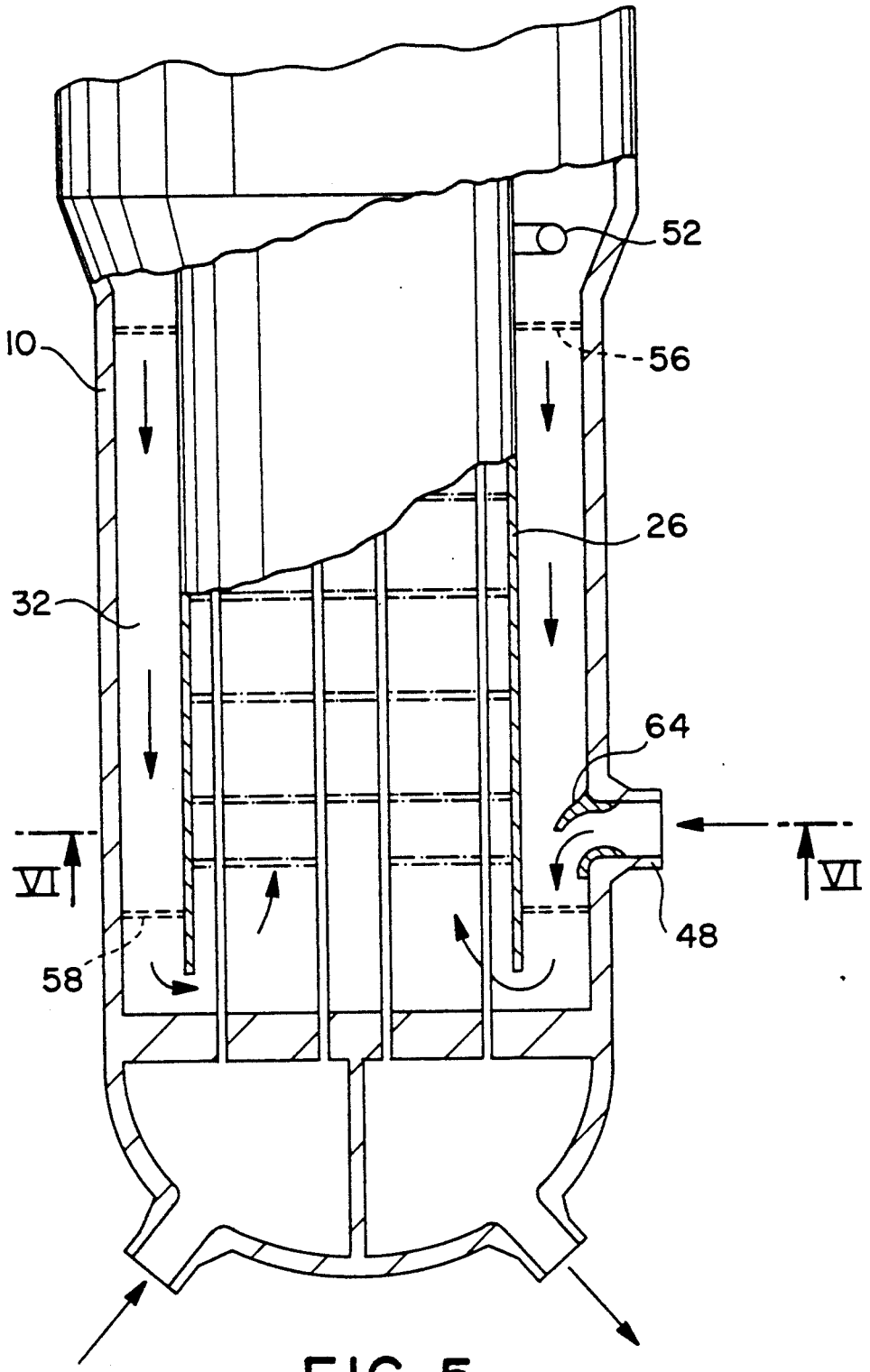
FIG. 5 is a vertical sectional view comparable to FIGS. 1 and 3 schematically showing an evaporator-type boiler according to the invention.

Finally, a description will now be given with reference to FIGS. 5 and 6 of an evaporator-type boiler according to the invention. This boiler essentially differs from that described with reference to FIGS. 3 and 4 by the fact that it has no partitions 36 and 62.

The evaporator-type boiler illustrated in FIGS. 5 and 6 has characteristics similar to those of the previously described boilers, so that only the differing characteristics will now be described.

As in the embodiment of FIGS. 3 and 4, the supply pipe 48 issues directly into the annular recirculation space 32. However, in this case a deflector 64 is placed in the extension of pipe 48, so as to deflect downwards, as from its entry in the space 32, the feed water flow introduced by the pipe 48.

Moreover, in view of the fact that the annular recirculation space 32 is not subdivided into two semiannular parts as is the case in FIGS. 3 and 4, the perforated collar 56 placed at the top of the annular recirculation space at a level above that of the supply pipe 48 occupies the entire periphery of that space.

In this case, the main function of the perforated collar 56 is to ensure the desired distribution of the recirculated water flowing into the space 32 between the parts of the space surrounding the cold branches of the tubes 24 and the parts of the spaced surrounding the hot branches. To this end, the perforations in the preferred collar 56 can ensure a preferred distribution of the recirculation water on the side of the hot branches or, conversely, a substantially uniform distribution of the recirculation water over the entire periphery of the annular space 32.

As in the embodiment of FIGS. 3 and 4, a first migrating body trapping device 58 is placed in the annular recirculation space 32 at a level below that of the supply pipe 48. In this case, device 58 extends over the entire periphery of the space 32.

Moreover, migrating body trapping device 58 is advantageously in the form of a distribution collar, whose perforations have a maximum diameter smaller than the minimum distance between the tubes 24 of the bundle. Moreover, these perforations have variable cross-sections over the entire periphery of the apparatus 58, so as to produce flow limitations and pressure drops of a variable nature making it possible to control the distribution of the feed water and recirculation water flow rates entering the inner envelope 26, at the bottom of the bundle of tubes.

In this case, the perforated collar 56 placed below the standby supply collector 52 can also constitute a second device for trapping migrating bodies which might be introduced by collector 52. For this purpose, the perforations in the collar 56 have a maximum diameter smaller than the maximum distance between the tubes 24 of the bundle.

By way of illustration, the combined effect of the deflector 64 and the distribution collar forming the migrating body trapping device 58 can lead to a distribution of the feed water introduced into the generator by the supply pipe 48 with approximately 80% on the side of the cold branches of the tubes 24 and approximately 20% on the side of the hot branches.

The deflector 64 described with reference to FIG. 6 can also be used in other embodiments. Moreover, the steam generator can have several supply pipes 48 without exceeding the scope of the invention.

I claim:

1. Boiler comprising a vertically axed, outer envelope;

a horizontal tube plate tightly fixed within the outer envelope;

a bundle of inverted U-tubes having hot branches and cold branches and each having two ends fixed to the tube plate and issuing below the tube sheet respectively into an admission collector and into a discharge collector for the primary fluid;

an inner envelope covering the tube bundle and having a lower edge spaced from the tube plate and forming with the outer envelope an annular recirculation space;

secondary water supply means comprising at least one supply pipe issuing directly into the annular recirculation space, at least one perforated collar being placed in the annular recirculation space at a higher level than that of the supply pipe, so as to oppose any rising of secondary water into said space and so as to ensure controlled circumferential distribution of the recirculation water descending into said space; and means for the separation of recirculation water able to drop again through said space secondary steam which can be extracted from the boiler, said separating means being positioned above the inner envelope.

2. Boiler according to claim 1, comprising first migrating body trapping means located in the annular recirculation space at a level below a level of the supply pipe.

3. Boiler according to claim 1, comprising a standby supply collector located above the annular recirculation space, and second migrating body trapping means located in the annular recirculation space below the standby supply collector.

4. Boiler according to claim 1, comprising a deflector located within the annular recirculation space, in the extension of each supply pipe, in order to downwardly deflect the secondary water.

5. Boiler according to claim 1, comprising an intermediate skirt at least partly duplicating the inner envelope around the cold branches of the tubes, said intermediate skirt defining with the inner envelope a superheated zone belonging to the annular recirculation space, the supply pipe issuing into said superheated zone and said perforated collar being located in the superheated zone.

6. Boiler according to claim 1, wherein a lower part of the annular recirculation space is subdivided into a first region surrounding the cold branches of the tubes and a second region surrounding the hot branches of the tubes by a vertical partitions, the supply pipe issuing into the first region of the perforated collar being located above said first region.

7. Boiler according to claim 1, wherein the supply pipe issues into the annular recirculation space on the side of the cold branches of the tubes, the perforated collar extending over the entire circumference of said annular space, while a distribution collar having perforations of variable cross-section extends over the entire circumference of the annular space, at a lever below the level of the supply pipe.

8. Boiler according to claim 1, wherein the perforated collar has perforations with a maximum diameter smaller than the minimum distance between the tubes of the bundle.

9. Boiler according to claim 7, wherein the perforations of the distribution collar have a maximum diameter smaller than the minimum distance between the tubes of the bundle.

* * * * *